US011278167B2

(12) United States Patent
Swails et al.

(10) Patent No.: US 11,278,167 B2
(45) Date of Patent: Mar. 22, 2022

(54) PAPER PRODUCT DISPENSER

(71) Applicant: Kimberly-Clark Worldwide, Inc., Neenah, WI (US)

(72) Inventors: Marvin E. Swails, Alpharetta, GA (US); Emily J. Langley, Dunwoody, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 152 days.

(21) Appl. No.: 16/474,018

(22) PCT Filed: Dec. 30, 2017

(86) PCT No.: PCT/US2017/069147
§ 371 (c)(1),
(2) Date: Jun. 26, 2019

(87) PCT Pub. No.: WO2018/126237
PCT Pub. Date: Jul. 5, 2018

(65) Prior Publication Data

US 2020/0245824 A1 Aug. 6, 2020

Related U.S. Application Data

(60) Provisional application No. 62/440,824, filed on Dec. 30, 2016.

(51) Int. Cl.
*A47K 10/38* (2006.01)

(52) U.S. Cl.
CPC ..... *A47K 10/38* (2013.01); *A47K 10/3836* (2013.01)

(58) Field of Classification Search
CPC ... A47K 10/38; A47K 10/3836; B65H 75/185
See application file for complete search history.

(56) References Cited

U.S. PATENT DOCUMENTS

| | | | | |
|---|---|---|---|---|
| 1,154,632 A | | 9/1915 | Hoberg | |
| 2,701,109 A | * | 2/1955 | Moore | A47K 10/22 242/598.1 |
| 2,942,795 A | * | 6/1960 | McCreary | A47K 10/38 242/596.4 |
| 3,288,387 A | | 11/1966 | Craven, Jr. | |
| 3,572,600 A | * | 3/1971 | Jespersen | A47K 10/3687 242/423.1 |
| 4,671,466 A | * | 6/1987 | Jespersen | A47K 10/38 242/560.3 |
| 4,762,061 A | | 8/1988 | Watanabe et al. | |
| 5,100,074 A | * | 3/1992 | Jones | B65H 59/387 242/411 |
| 5,125,586 A | | 6/1992 | Whitethorn | |
| 5,181,670 A | | 1/1993 | Eaton et al. | |
| 5,186,099 A | | 2/1993 | Qing et al. | |

(Continued)

FOREIGN PATENT DOCUMENTS

| | | |
|---|---|---|
| CN | 2734110 Y | 10/2005 |
| EP | 0758539 B1 | 1/2000 |

(Continued)

*Primary Examiner* — Michael E Gallion

(57) ABSTRACT

Systems and apparatus for dispensing of paper products. The dispenser includes two vertically offset rollers configured to be inserted in a rolled paper product to support it in an elliptical shape.

13 Claims, 1 Drawing Sheet

(56) References Cited

U.S. PATENT DOCUMENTS

| | | | | |
|---|---|---|---|---|
| 5,249,755 | A * | 10/1993 | Jespersen | A47K 10/38 242/596.7 |
| 5,277,375 | A | 1/1994 | Dearwester | |
| 5,340,050 | A * | 8/1994 | Renck | B65H 75/185 242/609.1 |
| 5,762,285 | A * | 6/1998 | Lin | A47K 10/3836 242/565 |
| 5,782,428 | A * | 7/1998 | Chabot | A47K 10/38 242/596.3 |
| 7,913,945 | B2 | 3/2011 | Friesen et al. | |
| 7,967,235 | B2 * | 6/2011 | Forman | A47K 10/3662 242/560 |
| 8,152,021 | B2 | 4/2012 | Babikian | |
| 8,740,129 | B2 | 6/2014 | Keily et al. | |
| 2002/0050543 | A1 * | 5/2002 | Romes | B65H 16/08 242/422.5 |
| 2004/0159730 | A1 | 8/2004 | Kubota et al. | |
| 2005/0056718 | A1 * | 3/2005 | Kamenstein | B65H 16/005 242/422.4 |
| 2007/0290094 | A1 | 12/2007 | Anderson | |
| 2009/0057169 | A1 | 3/2009 | Kruchoski et al. | |
| 2009/0057456 | A1 | 3/2009 | Shannon et al. | |
| 2011/0114778 | A1 * | 5/2011 | Andersson | A47K 10/40 242/160.1 |
| 2014/0353418 | A1 | 12/2014 | Hagleitner | |
| 2015/0136894 | A1 * | 5/2015 | Kling | B65H 75/10 242/564 |
| 2016/0137398 | A1 | 5/2016 | Lemke et al. | |
| 2016/0157682 | A1 * | 6/2016 | Keily | A47K 10/38 242/563.2 |

FOREIGN PATENT DOCUMENTS

| | | | |
|---|---|---|---|
| JP | 4053638 | U1 | 5/1992 |
| JP | 9030668 | A | 2/1997 |
| JP | 2004001864 | A | 1/2004 |
| JP | 3127696 | U | 12/2006 |

* cited by examiner

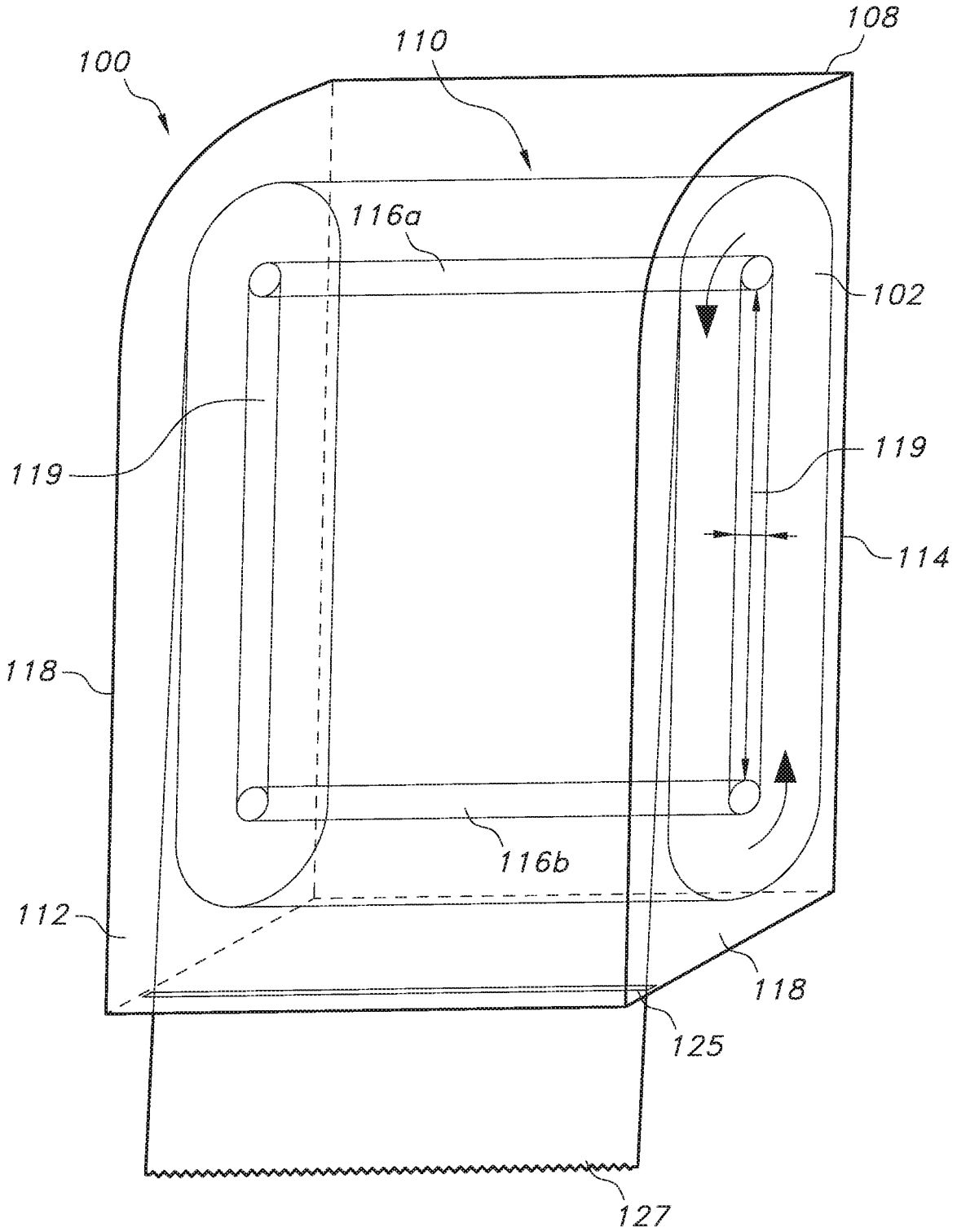
100
110
108
116a
102
119
119
114
118
116b
112
118
125
127

PAPER PRODUCT DISPENSER

This application claims priority from U.S. provisional Patent Application Ser. No. 62/440,824 filed on Dec. 30, 2016, the entire contents of which are incorporated herein by reference.

This disclosure generally relates to a rolled paper product dispensing system.

BACKGROUND

Systems dispensing consumable products are ubiquitous in many environments today. For example, consumable product, e.g., hand towel, dispensers are commonplace in many private, semi-private and public washrooms, break rooms, kitchens and work spaces. It is often desirable to product as many sheets as possible on a paper product roll to reduce the number of times the dispenser needs to be refilled. It is also desirable in many environments to minimize the form factor or footprint of the dispenser to make it less intrusive. Balancing these two competing interests can be quite challenging.

SUMMARY

In general, the subject matter of this specification relates to a paper product dispenser for rolled paper products. One aspect of the subject matter described in this specification can be implemented in systems that include a housing comprising a front, a back, two sides and a product holding area defined at least in part by the front, back and two sides; a first roller extending in a direction from one side to the other and positioned in an upper portion of the product holding area, and a second roller extending in a direction from one side to the other and positioned in a lower portion of the product holding area, wherein the first and second rollers are configured to pass through a core of a rolled paper product in the product holding area and to engage a top and bottom, respectively, of the core. Other embodiments of this aspect include corresponding apparatus and methods.

Yet another aspect of the subject matter described in this specification can be implemented in a method including unwinding an elliptically shaped rolled paper product in a dispenser, wherein the dispenser has a first roller inserted into and engaging a top portion of a core of the rolled paper product and a second roller inserted into and engaging a bottom portion of the core. Other embodiments of this aspect include corresponding apparatus and systems.

In some implementations, the systems, apparatuses and methods described herein have one or a combination of the following features. The first roller and second rolled are in a same vertical plane. The rolled paper product are hand towels. The roller paper product has an unwound length of between 1500 and 2000 feet. The rolled paper product is tubeless. The first roller and second rollers are configured to rotate as the rolled paper product is unwound and dispensed.

The first and second rollers are at least five inches apart. The first and second rollers are at least seven inches apart. The first and second rollers are at least nine inches apart. The first and second rollers are configured to unwind the rolled paper product in a counterclockwise direction. The core has an elliptical shape. The rolled paper product has an elliptical shape.

Particular embodiments of the subject matter described in this specification can be implemented so as to realize one or more of the following advantages. It is desirable to minimize the depth of a dispenser (e.g., the distance the dispenser protrudes horizontally out from the wall or other surface it's mounted on). For circular rolls minimizing the dispenser's depth results in a small diameter roll, which has a shorter length than a comparable roll with a larger diameter. To accommodate a reduced depth but not give up roll length the dispenser described herein is configured to hold elliptically shaped rolls, which allows the dispenser to have a reduced depth without sacrificing roll length—as the roll is elongated in the vertical direction (height) which is often a less critical design dimension.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWING

FIG. 1 is a representation of an example paper product dispenser.

DETAILED DESCRIPTION

The present disclosure generally relates to a rolled paper product dispenser that includes upper and lower roller arms configured to be inserted into the core or center of a paper product roll, e.g., hand towel roll, to support the roll in an elliptical shape (or support an elliptical roll) during unwinding and dispensing.

In some implementations, the dispenser includes two roll support rollers. These rollers extend through the core of a paper product roll and support the roll in the dispenser and allow the roll to be unwound for dispensing to a user. More particularly, the rollers are arranged in stacked vertical relation (e.g., in a same vertical plane) such that one roller engages the bottom of the core and the other engages the top of the core to support the roll in an elliptical shape, e.g., in a vertically elongated shape. This allows the dispenser to have a reduced depth and smaller horizontal footprint while not sacrificing the sheet length of the roll as compared to circular shaped rolls. The dispenser is described in more detail below with reference to FIG. 1, which is a representation of an example product dispenser 100.

The dispenser 100 can be, for example, a hand towel dispenser 100, or the like, e.g., bath tissue or wipers/wipers, for rolled paper products 102. A paper product describes sheet materials made from cellulose fibers (e.g., wood pulp), synthetic fibers (e.g., polypropylene) or some combination thereof, and include, for example, bath tissue, paper towels and wipes/wipers. A rolled product is a product that is wound around a core or center axis, e.g., the axis around which the paper product 102 is wound.

The dispenser 100 includes a body 108, e.g., a composite or metal housing, with an outer surface, e.g., an exterior surface of the body 108. The dispenser 100 also includes a product holding area 110 to hold the paper product 102. As shown in FIG. 1, the dispenser 100 is illustrated with the front cover 112 of the body 108 and sides 118 see through to show the product holding area 110 and roll 102.

In some implementations, the product holding area 110 is a space or cavity within the body 108 in which the product 102 can be positioned for dispensing, and can be accessed by rotating the front cover 112 away from the back cover 114 (e.g., the wall mounted portion) by a hinge or the like. The dispenser 100 also includes a first roller 116*a* and a second roller 116*b* in the product holding area 110. In combination, the first and second rollers 116 are used to hold and support the paper product roll 102 in an elliptical or (vertically) elongated shape, and to facilitate unwinding the roll 102 for dispensing to a user. In FIG. 1 the roll 102 is shown as rotating in a counterclockwise direction but in other implementations it can rotate in a clockwise direction.

The first roller 116*a* extends in a direction from one side 118 to the other 118 and is positioned in an upper portion of the product holding area 110. The second roller 116*b* extends in a direction from one side 118 to the other 118 and is positioned in a lower portion of the product holding area 110. As such, the first and second rollers 116 are configured to pass through the core 119 of a rolled paper product 102 and to engage a top and bottom, respectively, of the core 119. In some implementations, the rollers 116 are in a same vertical plane. The rollers 116 can be, for example, directly connected to and supported by the sides 118 or held by arms or other support devices such that the rollers 116 are not directly connected to the sides 118.

The rollers 116, in some implementations, rotate along with the roll 102 as it unwinds. In other implementations, the rollers 116 are stationary and do not rotate as the roll 102 unwinds but, rather, the roll 102 "slips" across the rollers 116 as it unwinds. In some implementations, the roll 102 is tubeless and has an elliptical shape and/or the roll 102 is held in an elliptical shape by the rollers 116. A roll 102 having or being held in an elliptical or elongated shape describes a roll that has a height (measured in a vertical direction when the roll 102 is positioned for dispensing in a dispenser 100) at least 25% (or at least 50% or at least 75% or at least 100% or at least 150% or at least 200%) greater than its width (measured in a horizontal direction when the roll 102 is positioned for dispensing in a dispenser 100). In some implementations, the rolled paper product 102 has an unwound length of between 1500 and 2000 feet.

In some implementations, the first and second rollers 116 are at least five inches apart, at least seven inches apart or at least nine inches apart. The roll 102 can be perforated thereby defining sheets or a tear bar or the like can cut the unwound portion 127 of the roll 102 for dispensing through the opening 125.

An example process for dispensing paper product is described below. In some implementations, an elliptically shaped rolled paper product 102 (or a paper product roll held in an elliptical shape) is unwound through a dispenser 100 as described above. For example, the dispenser 100 has a first roller 116*a* inserted into and engaging a top portion of a core 119 the rolled paper product 102 and a second roller 116*b* inserted into and engaging a bottom portion of the core 119. As the roll 102 is unwound, e.g., either through rotation of the rollers 116 or slipping across the rollers 116, it is dispensed out of the opening 125 to a user.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A dispenser comprising:

a housing comprising a front, a back, two sides and a product holding area defined at least in part by the front, back and two sides;

a first roller extending in a direction from one side to the other and positioned in an upper portion of the product holding area, and a second roller extending in a direction from one side to the other and positioned in a lower portion of the product holding area, wherein the first and second rollers are configured to pass through a core of a rolled paper product in the product holding area and to engage a top and bottom, respectively, of the core, wherein at least one of the first and second rollers is stationary and does not rotate as the rolled paper product unwinds.

2. The dispenser of claim 1, wherein the first roller and second roller are in a same vertical plane.

3. The dispenser of claim 1, wherein the rolled paper product are hand towels.

4. The dispenser of claim 1, wherein the rolled paper product has an unwound length of between 1500 and 2000 feet.

5. The dispenser of claim 1, wherein the rolled paper product is tubeless.

6. The dispenser of claim 5, wherein the first and second rollers are at least seven inches apart.

7. The dispenser of claim 6, wherein the first and second rollers are at least nine inches apart.

8. The dispenser of claim 1, wherein the core has an elliptical shape.

9. The dispenser of claim 1, wherein the rolled paper product has an elliptical shape.

10. A method comprising:

unwinding an elliptically shaped rolled paper product in a dispenser, wherein the dispenser has a first roller inserted into and engaging a top portion of a core of the rolled paper product and a second roller inserted into and engaging a bottom portion of the core, and wherein at least one of the first and second rollers is stationary and does not rotate as the rolled paper product unwinds.

11. The method of claim 10, wherein the first roller and second roller are in a same vertical plane.

12. The method of claim 11, wherein the first roller and second roller are separated by at least five inches.

13. A dispenser comprising:

a housing comprising a front, a back, two sides and a product holding area defined at least in part by the front, back and two sides;

a first roller extending in a direction from one side to the other and positioned in an upper portion of the product holding area, and a second roller extending in a direction from one side to the other and positioned in a lower portion of the product holding area, wherein the first and second rollers are configured to pass through a core of a rolled paper product in the product holding area and to engage a top and bottom, respectively, of the core, wherein the first and second rollers are at least five inches apart.

* * * * *